US007813628B2

(12) United States Patent
Haan

(10) Patent No.: US 7,813,628 B2
(45) Date of Patent: Oct. 12, 2010

(54) INSTANTANEOUS STEAM BOILER

(76) Inventor: Gyung-Hee Haan, Miwon 2nd, Apt. 401, 433-9 Mangwon-Dong, Mapo-Gu, Seoul (KR)

( * ) Notice: Subject to any disclaimer, the term of this patent is extended or adjusted under 35 U.S.C. 154(b) by 155 days.

(21) Appl. No.: 12/001,840

(22) Filed: Dec. 12, 2007

(65) Prior Publication Data

US 2008/0141952 A1 Jun. 19, 2008

(30) Foreign Application Priority Data

Dec. 13, 2006 (KR) ..... 10-2006-0126835

(51) Int. Cl.
*F24H 1/18* (2006.01)

(52) U.S. Cl. ..... 392/441; 392/404; 392/397; 392/465

(58) Field of Classification Search ..... None
See application file for complete search history.

(56) References Cited

U.S. PATENT DOCUMENTS 941,215 A * 11/1909 Wade ..... 392/494
1,820,458 A * 8/1931 Jenkins ..... 392/484
4,334,141 A * 6/1982 Roller et al. ..... 392/467
4,343,988 A * 8/1982 Roller et al. ..... 392/467
4,351,385 A * 9/1982 Amey ..... 165/61
4,371,777 A * 2/1983 Roller et al. ..... 392/480
6,816,670 B1 * 11/2004 Renau ..... 392/467

FOREIGN PATENT DOCUMENTS

JP P09-192147 7/1997

OTHER PUBLICATIONS

Korean patent application No. 10-2006-0126835, Notice of Allowance, Examination Result, Written Argument, and Amendment.

* cited by examiner

*Primary Examiner*—Thor S Campbell

(57) ABSTRACT

The present invention relates to an instantaneous steam boiler generating steam in a steam cleaner, a steam-vacuum cleaner, a steam iron, etc. The instantaneous steam boiler includes a U-shaped heater and a separate flow tube arranged in parallel and contact with said heater. The flow tube may be arranged orthogonally or at a 180 degree opposite direction and may include a circular or square-shaped end with rounded edges, thereby increasing the heating/vaporization efficiency of the device.

3 Claims, 6 Drawing Sheets

INSTANTANEOUS STEAM BOILER

CROSS-REFERENCE(S) TO RELATED APPLICATIONS

1. Related Applications

The present invention claims priority from Korean patent application number 10-2006-0126835, filed on Dec. 13, 2006, which is also hereby incorporated by reference in its entirety.

2. Field of the Invention

The present invention relates to an instantaneous steam boiler generating steam in a steam cleaner, a steam-vacuum cleaner, a steam iron, etc. More specifically, the present invention relates to an instantaneous steam boiler featuring a short heater return line by curving or twisting a U-shaped heater return portion.

3. Background of the Invention

Steam boilers are largely classified into reservoir type water heaters and instantaneous water heaters. The reservoir type water heater has an electric boiler built in a water tank. By heating the steam boiler, water temperature increases and the heated water finally generates steam (vapor). The steam is then discharged through a steam outlet on the top of the water tank.

FIG. 1 is an exploded perspective view of a conventional steam boiler, while FIG. 2 is a cross-sectional view taken along line A-A of FIG. 1. As shown in these figures, a conventional instantaneous steam boiler is provided with a body forming a water transfer tube and including an inlet 22 for water and an outlet 23 for steam formed on both ends of the transfer tube and a built-in heater 25. The body is divided into a first body 10 and a second body 20 connected to the first body 10 to form the transfer tube, and a packing 30 for preventing leakage of water from the tube is interposed between the first body 10 and the second body 20. The heater 25 is built in the second body 20, and a plurality of projections 26 are formed protrusively on a bottom surface of a transfer tube forming portion 21. These projections 26 interfere with rapid flow of water to increase contact time between water and the heater, thereby increasing the heat transfer so that steam may be generated in a stable manner.

However, since heat is transferred from the heater 25 to the transfer tube (i.e., conduction system), the transfer tube is typically made long (curved U-shape tube) and wide in order to produce sufficient steam. When the transfer tube has an extended length, it is more likely to retain water therein and fur exposure is inevitable. That is to say, it is rather natural that the transfer tube constantly being exposed to water is furred up (because of the presence of impurities) or has an oxidation coating or scale (which is a thin film of an oxide formed on the surface of metal as a result of chemical reaction when the metal is heated) especially when the tube is made out of metal. Such fur or oxidation coating is descaled when it reaches a certain thickness. Unfortunately though, this descaled fur or oxidation coating is particularly fatal to the instantaneous steam boiler. Because a steam outlet of a conventional instantaneous steam boiler normally has a small volume and a very small diameter, the boiler may easily get clogged up, producing steam in an unstable and non-uniform manner and losing pump pressure. These drawbacks are led to a serious deterioration in the durability of the steam boiler.

In addition, a complicated mold structure is required to form the projections 26 and a separate process needs to be done in order to connect/separate an upper and a lower body. Prior art instantaneous water heaters are normally built in a body made of a thermoconductive metal such as aluminum having a water transfer tube (or hose) formed therein. When the heater temperature increases, its heat is transferred to the body and water traveling inside the transfer tube in the body is eventually converted into steam.

It is, therefore, an object of the present invention to provide an instantaneous steam boiler made in a smaller size by reducing the length of a U-shaped heater. It is a further object of the invention to eliminate the need for a complicated mold structure in an instantaneous steam boiler. Finally, it is a further object of the invention to reduce clogging by reducing oxidation in an instantaneous steam boiler.

SUMMARY OF THE INVENTION

In accordance with the present invention, there is provided an instantaneous steam boiler, including: a body composed of an inlet for water, an outlet for steam, and a flow path. The invention includes a U-shaped heater installed at the body and formed of two linear portions and a return portion, wherein the return portion of the heater is curved and twisted.

According to an exemplary embodiment of the present invention, the length of the heater is reduced as much as it is curved and twisted, so the entire steam boiler is consequently made smaller and lighter.

By adopting a structure of a flow tube where the water inlet, the steam outlet, and the flow path come in contact with the heater, the transfer path of the flow tube is substantially reduced through the contact with the heater and water does not remain stationed in the tube. This in turn makes it possible to suppress the formation of fur or an oxidation coating as much as possible. In addition, since the body is molded with the heater and the flow tube already inserted, an assembly/disassembly process is not required.

Moreover, with the U-shaped transfer tube, the contact efficiency between the tube and the heater increases, and a steam boiler incorporating such tube does not occupy a lot of space but is easily installed in a small space. Particularly, if the flow tube is made out of copper materials, it demonstrates excellent heat conductivity. Therefore, steam can be supplied in a stable manner even when the flow tube length is reduced even further.

The other objectives and advantages of the invention will be understood by the following description and will also be appreciated by the embodiments of the invention more clearly. Further, the objectives and advantages of the invention will readily be seen that they can be realized by the means and its combination specified in the claims.

DETAILED DESCRIPTION OF SPECIFIC EMBODIMENTS

Hereinafter, preferred embodiments of the present invention will be set forth in detail with reference to the accompanying drawings so that those skilled in the art can easily carry out the invention.

Embodiment I

Figure 3:
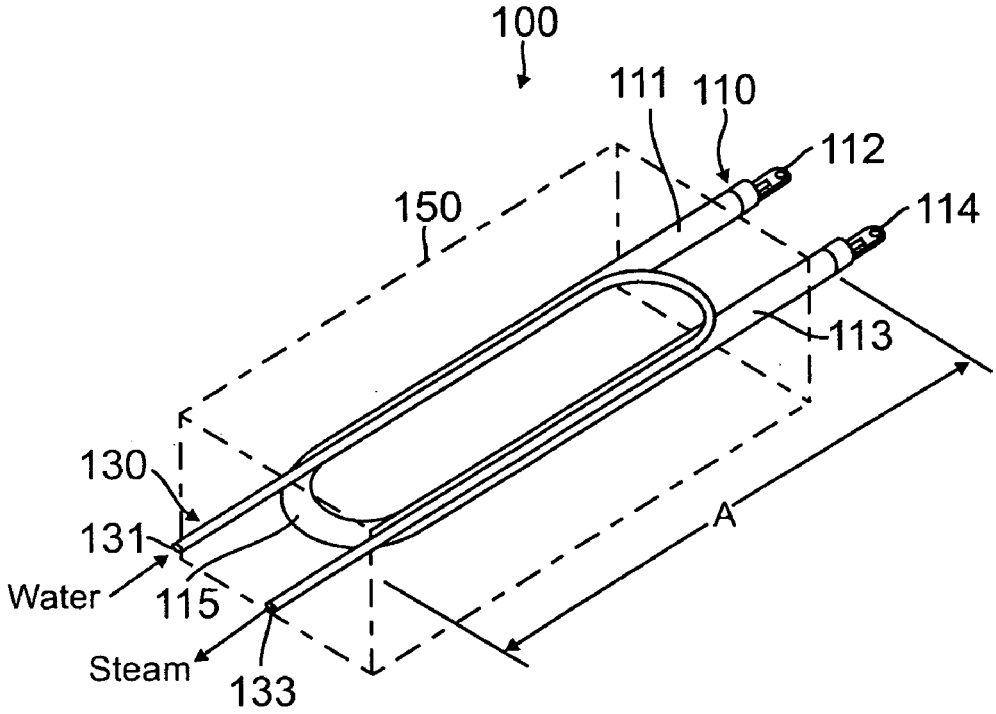
FIG. 3 is a perspective view of an instantaneous steam boiler with a heater and a flow tube arranged 180 degrees apart, facing opposite directions.

FIG. 3 is a perspective view of an instantaneous steam boiler having a heater and a flow tube arranged 180 degrees apart, facing opposite directions, in accordance with a first preferred embodiment of the present invention. Referring to FIG. 3, a steam boiler 100 according to a first embodiment of the present invention is constituted by a U-shaped heater 110, a U-shaped flow tube 130, and a body 150 for housing said heater 110 and said flow tube 130. Because the flow tube 130 is a separate tube which is formed and then embedded in the body 150, a molding process of the body for forming a complicated flow path within said body is much simplified, compared with conventional techniques for forming a flow path.

The heater 110 is preferably formed into a U shape. That is, the heater 110 is composed of a first linear portion 111 and a second linear portion 113 in parallel to each other and an arc-shaped return portion 115. Ports 112 and 114 are formed at the other ends of the first linear portion 111 and the second linear portion 113.

Similar to the heater 110, the flow tube 130 is also preferably formed into a U shape. One end of the flow tube 130 functions as an inlet 131 for water and a second, and opposite end functions as an outlet 133 for steam. As further shown in FIG. 3, the flow tube 130 and the heater 110 are arranged 180 degrees apart, facing opposite directions, with the flow tube 130 lying in a position on top of and parallel to the heater 110. In the drawing, the water inlet 131 and the steam outlet 133 of the flow tube 130 are arranged on the left hand side of body 150, while the ports 112 and 114 of heater 110 are arranged on the right hand side of body 150.

Design of a U-shaped flow tube 130 arranged in parallel with the heater 110, rather than a linear shaped flow tube, increases the flow of water over the heater, thereby increasing the exposure to heat and maximizing steam production. More specifically, as the flow tube 130 and the heater 110 are brought into contact with each other, heat is transferred to the flow tube 130 by direct heating, not by conduction, convection, or radiation.

Moreover, use of such a flow tube design, rather than conventional integral flow paths, improves efficiency since water is not left to stand in the tube. Accordingly, the steam outlet 133 can be kept from getting clogged up by fur or any oxidation coating.

Further, because the flow tube 130 and the heater 110 are in contact with each other, it is possible to mold the body 150 as one unit with the flow tube 130 and the heater 110 already inserted. That is to say, the heater 110 and the flow tube 130 lying upon the top of the heater 110 are tied up with a binding twine for example. The heater 110 and the flow tube 130 being tied up together are then inserted to a mold for forming the body 150. In so doing, the water inlet 131 and steam outlet 133 of the flow tube 130 and the ports 112 and 114 of the heater 110 are embedded in the body 150, while part of each being exposed to outside. The body 150 is obtained by die casting or injection molding. Molding of such a one unit body eliminates an assembly/disassembly process and improves productivity.

Preferably, the flow tube 130 is made out of copper material. Copper is nontoxic and demonstrates a high corrosion resistance and an excellent thermal conductivity so it contributes not only to a decrease in the length of the flow tube 130 but also to a substantial improvement on the evaporation rate (or water vaporization rate).

Finally, use of a separate U-shaped flow tube 130 arranged in a parallel and being in contact with the heater 110 in the steam boiler 100, reduces the traveling path of water and increases the evaporation rate. This enables to expand the diameters of the water inlet 131 and steam outlet 133, compared with conventional steam boiler designs. The diameter of the water inlet 131 is closely related to an amount of water input. Therefore, provided that the same amount of water is fed, an increased diameter can lower pump pressure, thereby reducing noises or vibrations as much as possible. Also, the wider steam outlet 133 allows the steam to easily escape despite the presence of small impurities in water, so the tube is hardly clogged up.

Embodiment II

Figure 1:
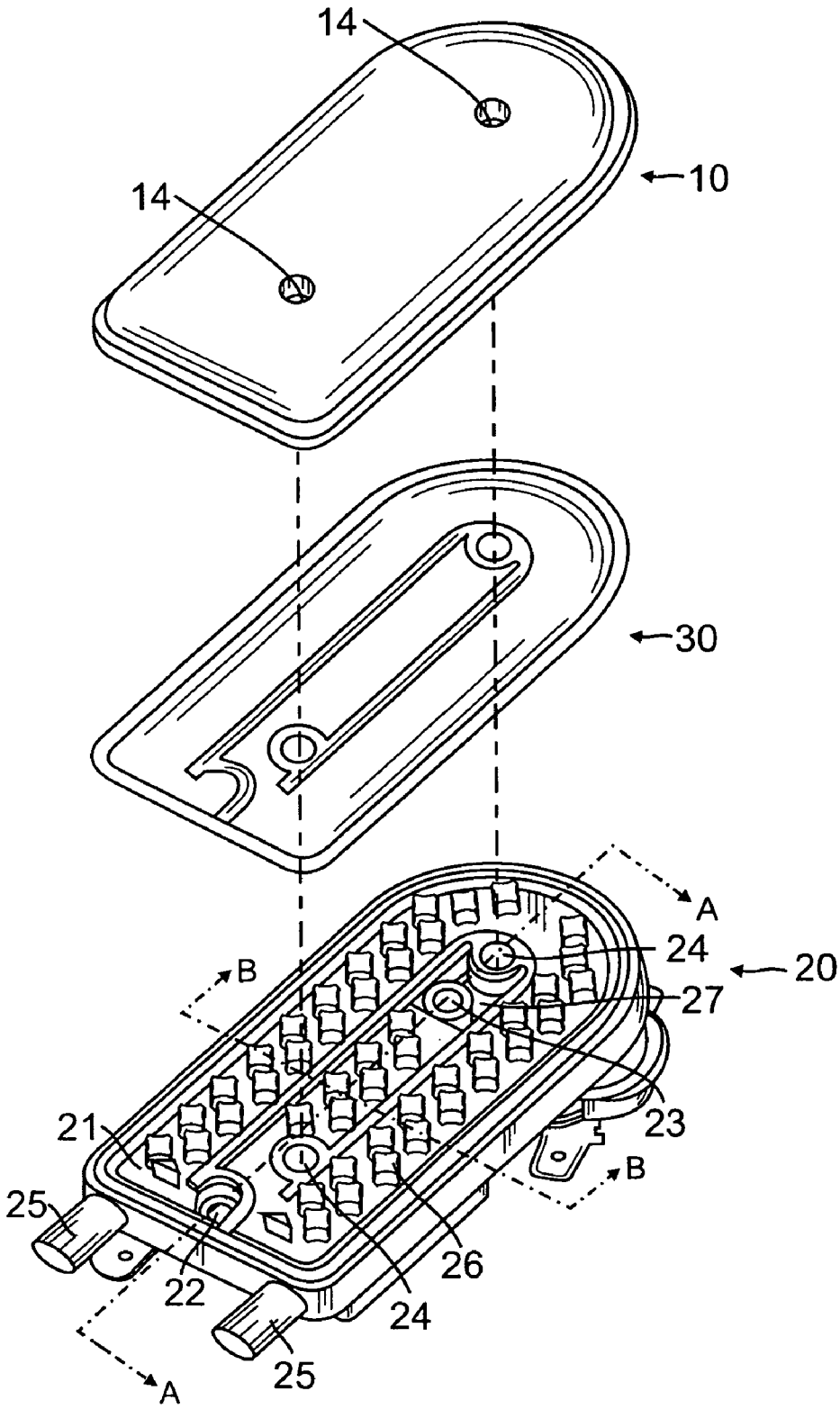
FIG. 1 is an exploded perspective view of a conventional, prior-art steam boiler.
Figure 2:
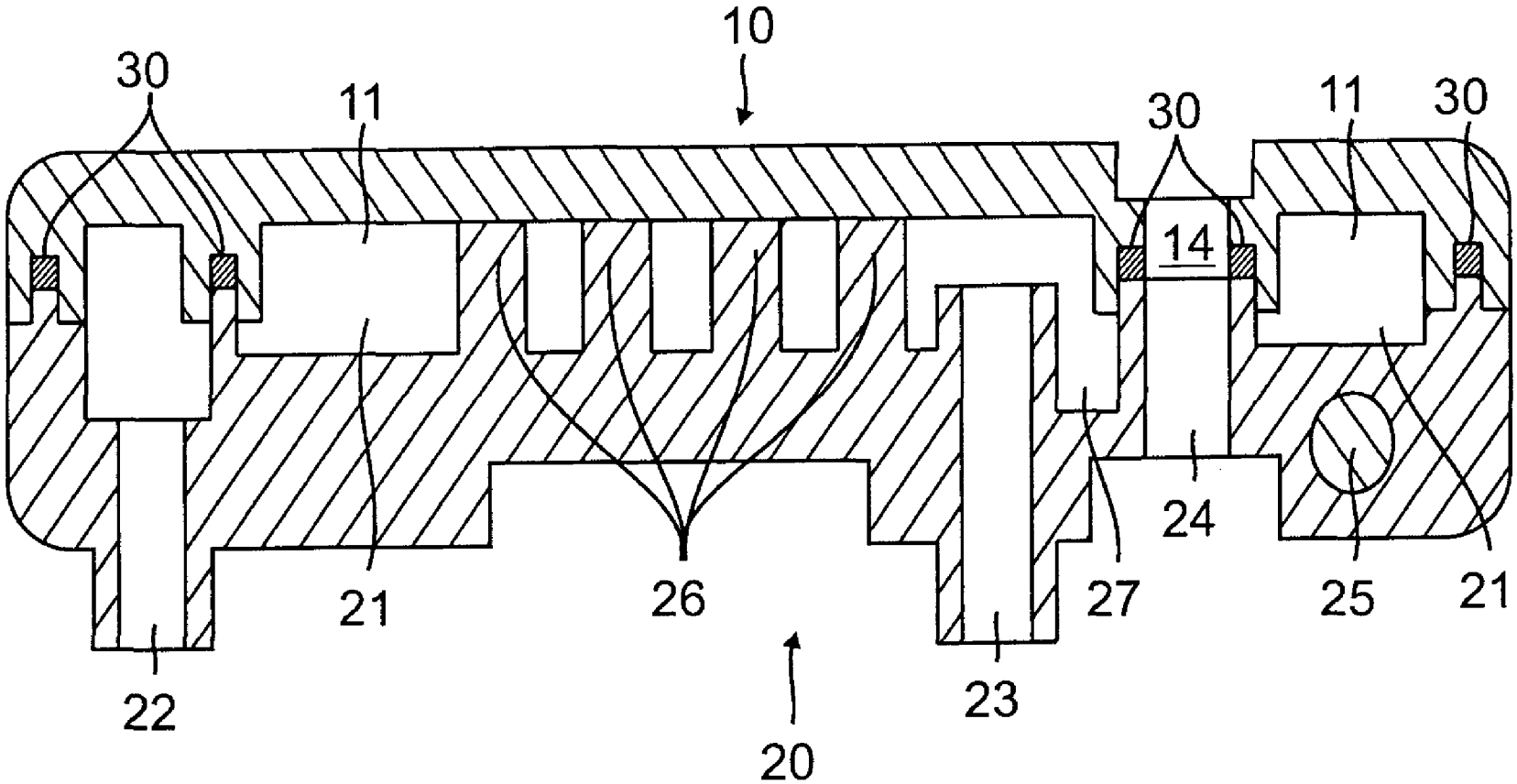
FIG. 2 is a cross-sectional view taken along line A-A of the prior-art steam boiler shown in FIG. 1.
Figure 4:
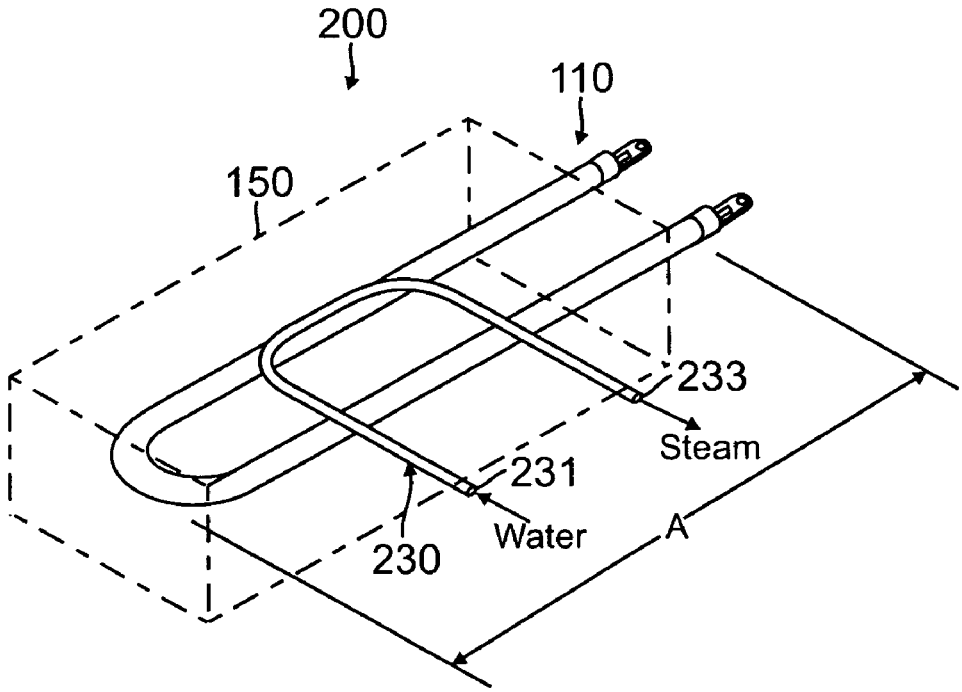
FIG. 4 is a perspective view of an instantaneous steam boiler in accordance with a second embodiment of the present invention.

FIG. 4 is a perspective view of an instantaneous steam boiler in accordance with a second preferred embodiment of the present invention. As shown in FIG. 2, although similar in structure and functions, a steam boiler 200 of the second embodiment differs from the steam boiler 100 of the first embodiment by an orthogonal arrangement of a flow tube 230 with respect to a heater 110. By placing the flow tube 230 at right angles to the heater 110, it becomes possible to adjust the gap between a water inlet 231 and a steam outlet 233 of the flow tube 230, thereby expanding the limit of the layout area for product design.

Embodiment III

Figure 5:
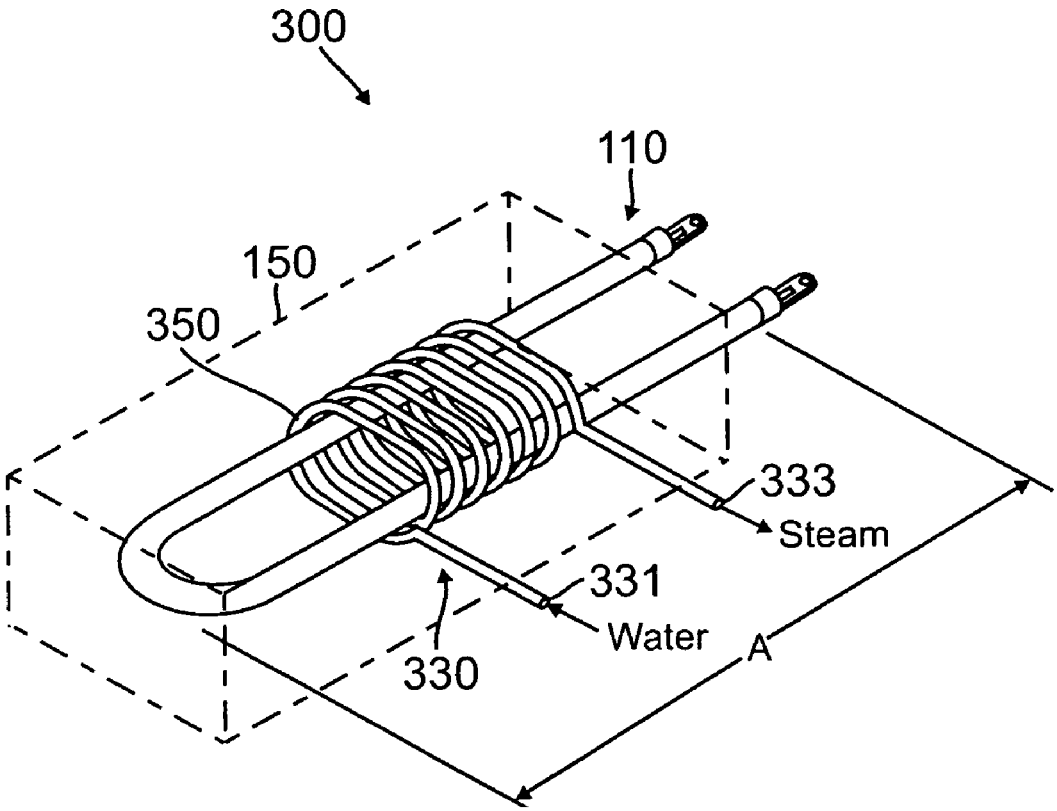
FIG. 5 is a perspective view of an instantaneous steam boiler in accordance with a third embodiment of the present invention.

FIG. 5 is a perspective view of an instantaneous steam boiler in accordance with a third preferred embodiment of the present invention. As shown in FIG. 3, although similar in structure and functions, a steam boiler 300 of the third preferred embodiment differs from the first and second embodiments in that said flow tube 330 is shaped in a coiled form, with a heater 110 arranged orthogonally inside the coil, such that the flow tube 300 is coiled about the heater.

Embodiment IV

Figure 6:
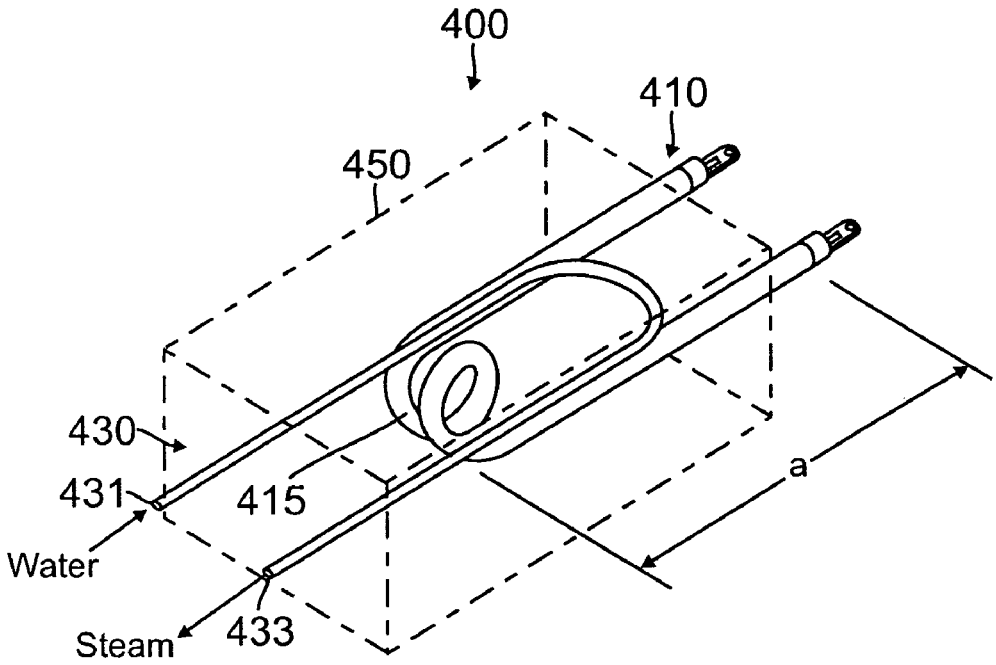
FIG. 6 is a perspective view of an instantaneous steam boiler in accordance with a fourth embodiment of the present invention.

FIG. 6 is a perspective view of an instantaneous steam boiler in accordance with a fourth preferred embodiment of the present invention. As shown in FIG. 6, although similar in structure and functions, a steam boiler 400 of the fourth embodiment differs from the steam boiler 100 of the previously described embodiments in that said heater 410 is arranged in a twisted form. More specifically, the heaters 110 in the first through third preferred embodiments are all formed in a U-shape along a horizontal plane. However, the heater 410 according to the fourth embodiment includes a vertically arranged loop 415 positioned along the curved portion of the U-shape. Therefore, because a body 450 now has a smaller size to fit in a narrow space, small and light products can be manufactured.

Such an arrangement allows the elongated portions of the heater to be reduced, thereby reducing the overall length of the heater and shortening the length of the body 450. That is, in case of a steam cleaner, a steam boiler is built in a main body with a bottom or is installed at an extension bar. When the steam boiler is built in the main body, the size of the main body is increased especially if the body 450 is large by itself. This makes it difficult to clean the gap between the steam boiler and the body. The space becomes even smaller when the main body is designed as a vacuum cleaner as well. Meanwhile, when the steam boiler is installed at the extension bar, it creates a large-size steam boiler that does not look stylish or neat in design. From these aspects, the coiled or twisted return portion 415 of the heater 410 is a first optimization process for producing small, light appliances. Moreover, the flow tube 430 can be made shorter as much as the reduced length of the body 450.

It is also evident to people skilled in the art that the length of the heater 410 can be reduced by bending the return portion 415 of the heater 410 into a further horizontal shape such that the overall shape of the heater is an M-shape. The operational effects of the heater 410 of the fourth embodiment are the same whether it is installed at a separate flow tube or whether it is built in a steam boiler with a body and a flow tube combined as one unit.

Embodiment V

Figure 7:
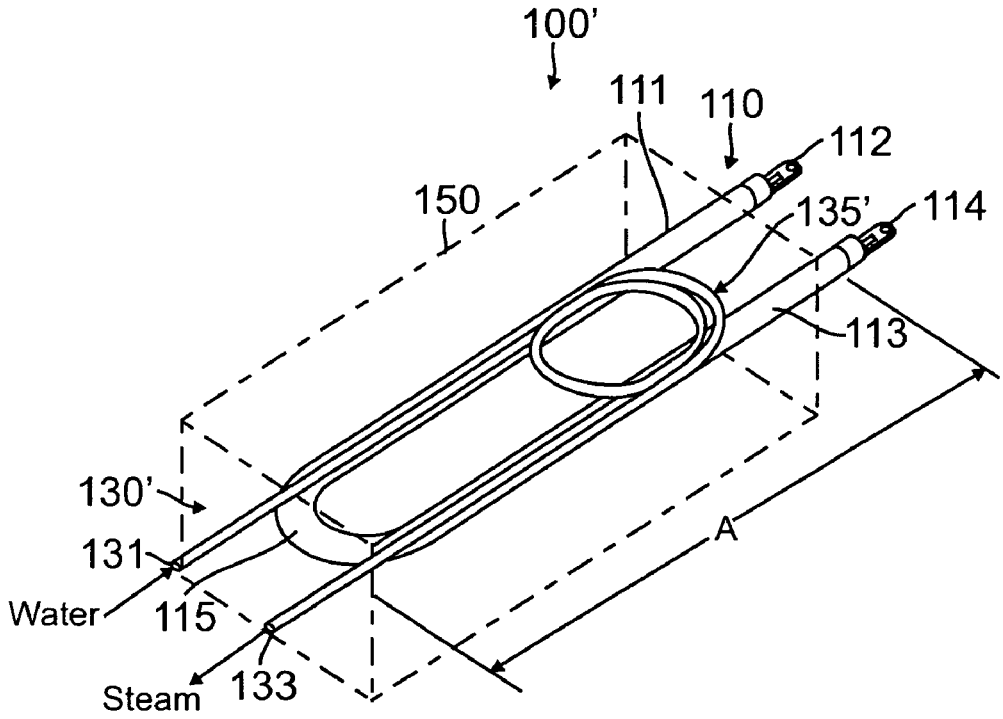
FIG. 7 is a perspective view of an instantaneous steam boiler in accordance with a fifth embodiment of the present invention.

FIG. 7 is a perspective view of an instantaneous steam boiler in accordance with a fifth preferred embodiment of the present invention. As shown in FIG. 7, although similar in structure and function to the steam boiler shown in FIG. 3 (having a heater and flow tube arranged in parallel fashion in a 180 degree alignment), the instantaneous steam boiler 100' of the fifth preferred embodiment illustrated in FIG. 7 differs from the steam boiler 100 of the previously described preferred embodiments in that a return/curved portion 135' of the U-shaped flow tube 130' is actually formed into a complete circle. In this way, the flow tube 130' has a circular end formed parallel to and in contact with the heater 110, thereby allowing the water in the flow tube 130' to pass over the heater 110 for a longer period of time, increasing the heating/vaporization efficiency of the device.

Embodiment VI

Figure 8:
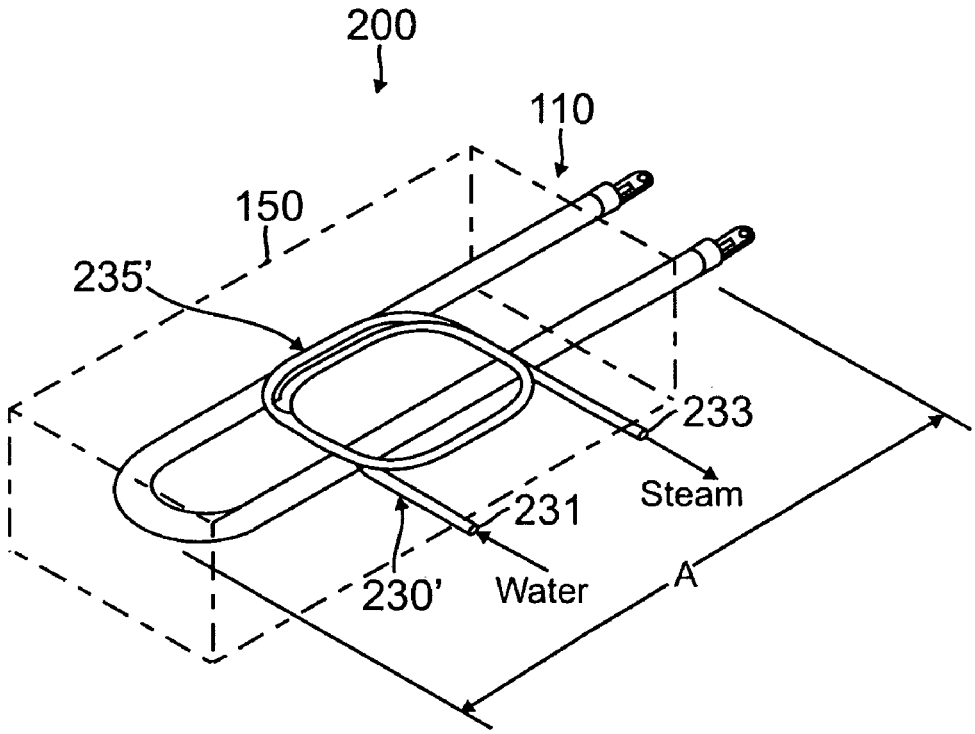
FIG. 8 is a perspective view of an instantaneous steam boiler in accordance with a sixth embodiment of the present invention.

FIG. 8 is a perspective view of an instantaneous steam boiler in accordance with a sixth preferred embodiment of the present invention. As shown in FIG. 6, although similar in structure and functions to the embodiment illustrated in FIG. 4, a steam boiler 200' of the sixth preferred embodiment differs in that a return portion 235' of the flow tube 230' is arranged into a curved-corner square shape. Accordingly, the flow tube 230' is orthogonally arranged in parallel contact with said heater 110 but the end of the flow tube is shaped into a square having curved edges. This design allows water flowing through the tube to pass over the heater more than once and for an extended period of time, thereby increasing the heating/vaporization efficiency of the device.

Embodiment VII

Figure 9:
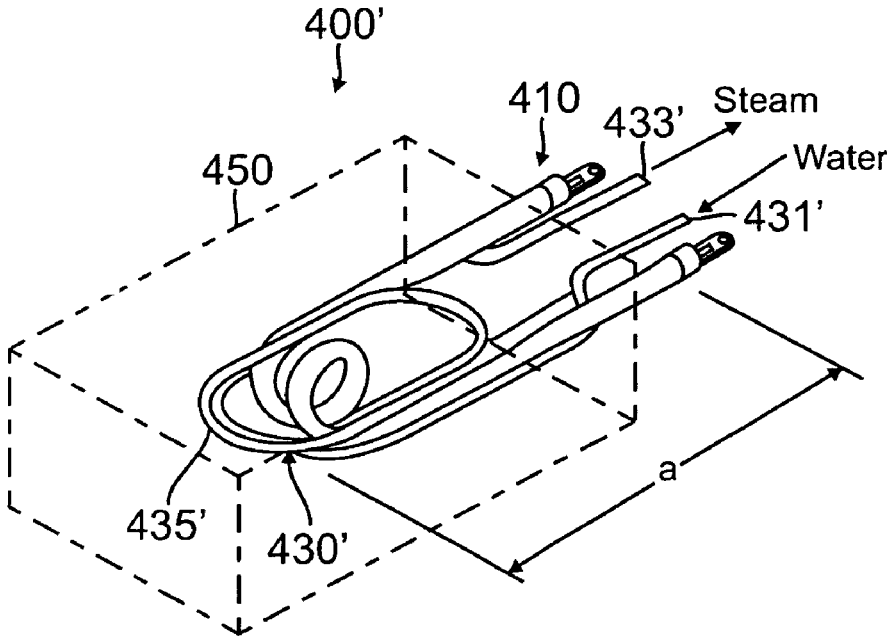
FIG. 9 is a perspective view of an instantaneous steam boiler in accordance with a seventh embodiment of the present invention.

FIG. 9 is a perspective view of an instantaneous steam boiler in accordance with a seventh preferred embodiment of the present invention. As shown in FIG. 9, although similar in structure and functions, a steam boiler 400' of the seventh preferred embodiment differs from the steam boiler 400 of the previously described embodiments in that a return portion 435' of a flow tube 430' is curved into an oval shape and a water inlet 431' and a steam outlet 433' are aligned parallel to and in the same direction as the ends of the heater 410 (rather than orthogonally or a 180 degree opposite alignment).

As has been explained so far, the instantaneous steam boiler of the present invention has the following advantages. With the twisted/coiled return portion of the U-shaped heater, the length of the heater is reduced as much as the twisted/coiled length. This substantially reduces the overall size of the steam boiler and further enables to manufacture small, light appliances.

In addition, by separately embodying the flow tube in contact with the U-shaped heater, heat transfer to the flow tube is done by direct heating, not by conduction, convection, or radiation. Therefore, even though the traveling path of water may be reduced substantially, water evaporation still takes place and water is not left to stand in the tube. Consequently, the steam outlet can be kept from getting clogged up by fur or an oxidation coating.

Moreover, because the flow tube and the heater are inserted to a mold for the body while they are in contact with each other, an assembly/disassembly process is no longer required and such a simple structure of the molding for the body can markedly lower manufacturing costs.

Besides, the U-shaped flow tube features a high contact efficiency with the heater yet occupies a small portion of the space defined in the product, resulting in a substantial decrease in manufacturing costs.

Further, in the preferred embodiments described herein, the flow tube is preferably made out of copper material which is nontoxic and demonstrates a high corrosion resistance and an excellent thermal conductivity. Therefore, even though the length of the flow tube may be shortened even further, steam can be supplied in a stable manner.

While the present invention has been described with respect to the specific embodiments, it will be apparent to those skilled in the art that various changes and modifications may be made without departing from the spirit and scope of the invention as defined in the following claims.

What is claimed is:

1. An instantaneous steam boiler, comprising:

a u-shaped heater having exactly two linear and parallel portions that are connected by a curved portion, the heater including a port at an end of each of the linear portions;

a u-shaped flow tube having exactly two linear and parallel tube sections that are connected by a curved section, a water inlet at one of the linear tube sections and a steam outlet at the other tube section, and where the curved section includes a loop that extends vertically with respect to the tube sections and the curved section;

wherein the linear tube sections are in contact with the linear portions of the u-shaped heater, with the tube sections being oriented in opposite directions with the linear portions such that the ports open out in a direction that is 180 degrees from the direction to which the water inlet and steam outlet open; and a body for housing the heater and flow tube.

2. An instantaneous steam boiler, comprising:

a u-shaped heater having exactly two linear and parallel portions that are connected by a curved portion, the heater including a port at an end of each of the linear portions, the curved portion including a loop that extends in the same plane as the linear portions;

a u-shaped flow tube having exactly two linear and parallel tube sections that are connected by a curved section, a water inlet at one of the linear tube sections and a steam outlet at the other tube section, and where the curved section includes a loop that extends vertically with respect to the tube sections and the curved section;

wherein the linear tube sections are in contact with the linear portions of the u-shaped heater, with the tube sections being oriented in the same direction with the linear portions such that the ports, the water inlet and the steam outlet open out towards the same direction; and a body for housing the heater and flow tube.

3. The boiler of claim 2, wherein the loop of the heater is oval-shaped.

* * * * *